US012270263B2

(12) United States Patent
Slaughter, Jr.

(10) Patent No.: US 12,270,263 B2
(45) **Date of Patent: *Apr. 8, 2025**

(54) DUAL ROD ASSEMBLY AND COLLAR INSTALLATION METHOD

(71) Applicant: The Charles Machine Works, Inc., Perry, OK (US)

(72) Inventor: Greg L. Slaughter, Jr., Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/541,378

(22) Filed: Dec. 15, 2023

(65) Prior Publication Data

US 2024/0117688 A1 Apr. 11, 2024

Related U.S. Application Data

(63) Continuation of application No. 18/068,196, filed on Dec. 19, 2022, now Pat. No. 11,851,956, which is a continuation of application No. 16/950,157, filed on Nov. 17, 2020, now Pat. No. 11,536,094.

(60) Provisional application No. 62/937,586, filed on Nov. 19, 2019.

(51) Int. Cl.

| | |
|---|---|
| ***E21B 17/16*** | (2006.01) |
| ***E21B 17/04*** | (2006.01) |
| ***E21B 17/042*** | (2006.01) |
| ***E21B 17/046*** | (2006.01) |

(52) U.S. Cl.
CPC ..... *E21B 17/16* (2013.01); *E21B 17/04* (2013.01); *E21B 17/0426* (2013.01); *E21B 17/046* (2013.01)

(58) Field of Classification Search
CPC ..... E21B 17/16; E21B 17/04; E21B 17/0426; E21B 17/046; F16L 37/244; F16L 37/565; F16L 39/005
See application file for complete search history.

(56) References Cited

U.S. PATENT DOCUMENTS

| | | | | |
|---|---|---|---|---|
| 2,331,474 | A | 10/1943 | Janoska | |
| 2,661,928 | A | 12/1953 | Topanelian | |
| 5,141,256 | A * | 8/1992 | Ziu | F16L 39/005 285/284.1 |
| 9,765,574 | B2 | 9/2017 | Slaughter, Jr. et al. | |
| 9,803,433 | B2 | 10/2017 | Slaughter, Jr. et al. | |

(Continued)

*Primary Examiner* — D. Andrews
(74) *Attorney, Agent, or Firm* — Tomlinson McKinstry, P.C.

(57) ABSTRACT

A retention system for attaching a collar to a pipe. The collar has an internally-disposed groove configured for placement of a ring. The ring is sized such that in one orientation, it can enter the collar between torque-transmitting features into the internally-disposed groove. Once in the groove, the ring may be adjusted such that its aperture is generally aligned with the axis of the collar. In this orientation, the features retain the ring within the groove. A bolt and a pipe may then be placed within the collar from opposite sides. The bolt is attached to the pipe through the ring. Once joined, the collar is joined to the pipe, forming its box end. Such a retention system may be used to join a series of inner pipe members of a dual-member pipe assembly, as in horizontal directional drilling.

18 Claims, 13 Drawing Sheets

(56) References Cited

U.S. PATENT DOCUMENTS

| | | | | |
|---|---|---|---|---|
| 10,487,595 | B2 | 11/2019 | Wilson et al. | |
| 11,536,094 | B2 | 12/2022 | Slaughter, Jr. | |
| 11,851,956 | B2 * | 12/2023 | Slaughter, Jr. | E21B 17/04 |
| 2015/0013963 | A1 | 1/2015 | McGarian | |
| 2018/0002990 | A1 * | 1/2018 | Wilson | F16L 21/08 |

* cited by examiner

DUAL ROD ASSEMBLY AND COLLAR INSTALLATION METHOD

SUMMARY

The present invention is directed to an assembly. The assembly comprises an elongate tubular collar, a retainer, and a bolt. The collar has a through-passage extending through it from opposed first and second ends. The first and second ends are defined by an inwardly-disposed surface having a torque-transmitting feature. The collar also has an internal groove interrupting the through-passage between the first and second ends. No torque-transmitting features are formed on the inwardly-disposed surface of the internal groove. The retainer has an aperture and is disposed entirely within the internal groove. The bolt has a first and second end. The bolt comprises a flange disposed about the first end and a threaded end configured for connection to a pipe. The flange has an outer diameter greater than the inner diameter of the aperture of the retainer.

The invention is directed to a kit. The kit comprises a tubular collar, a ring, and a bolt. The collar comprises a first end and a second end. The collar has a through-passage extending from the first end to the second end. The internally-disposed surfaces of the through-passage define a profile at each of the first end and the second end. The collar has a groove interrupting the through-passage. The groove has a larger inner diameter than the through-passage. The ring has an internal opening. The ring is configured such that the ring is retained within the groove when oriented such that the internal opening is aligned with the through-passage. The ring is further configured such that it is removable from the groove and the collar when oriented such that the internal opening is not aligned with the through-passage. The bolt is receivable within the ring and has a flange larger than the internal opening of the ring.

The invention is directed to an assembly comprising a collar, a ring, and a bolt. The collar has a through-passage. The through-passage defines a first section having a first inner profile and a second section having a second inner profile. The ring is configured to traverse the first section and second section of the through-passage in a first orientation. The ring is further configured to be prevented by the first inner profile from traversing the first section when in a second orientation and configured to be adjusted from the first orientation to the second orientation while within the second section of the through-passage. The bolt has a flange with an outer diameter greater than an inner diameter of the ring.

BRIEF DESCRIPTION OF THE DRAWINGS

FIGS. 6-11 are thus identical views of the pipe member, collar, ring and bolt in advancing stages of installation of the assembly. In these figures, the outer pipe member is removed so that the advancing assembly can be highlighted. However, it should be understood that in ordinary circumstances, an outer pipe member may be disposed around the inner pipe member and collar shown.

DETAILED DESCRIPTION

Torque-transmission devices are often used in drilling systems to allow for rotation along a multi-member drill string. In general, collars are installed at the joint between members in the drill string, or "pipe joints", using a roll pin, threaded fastener, or a ring retained by a spring. A typical torque-transmission device is a collar having an inner diameter or outer diameter that has a geometric feature, such as a flat or a polygonal profile, which is capable of transmitting torque.

A roll pin and threaded fastener both require access to install via impact drive with a hammer or via a wrench or similar rotary drive tool. As a result, the installation location of the collar must be exposed from the outer pipe when the device is installed. A spring retained ring described is disclosed at U.S. Pat. Nos. 10,487,595, ("the '595 Patent") issued to Wilson, et al., and U.S. Pat. No. 9,803,433, issued to Slaughter, Jr., ("the '433 Patent") the contents of which are incorporated herein by reference. The ring in the '595 Patent and '433 Patent is installed while inside the pipe, gaining the advantage of maintaining tighter tolerances during drill string assembly, shorter overall finished assembly lengths, and eliminating the need to expose the inner pipe member. However, these retainer rings are sacrificial and must be replaced each time its collar is removed. Therefore, a removable ring to retain the collar to the inner pipe member would be advantageous.

Figure 1:
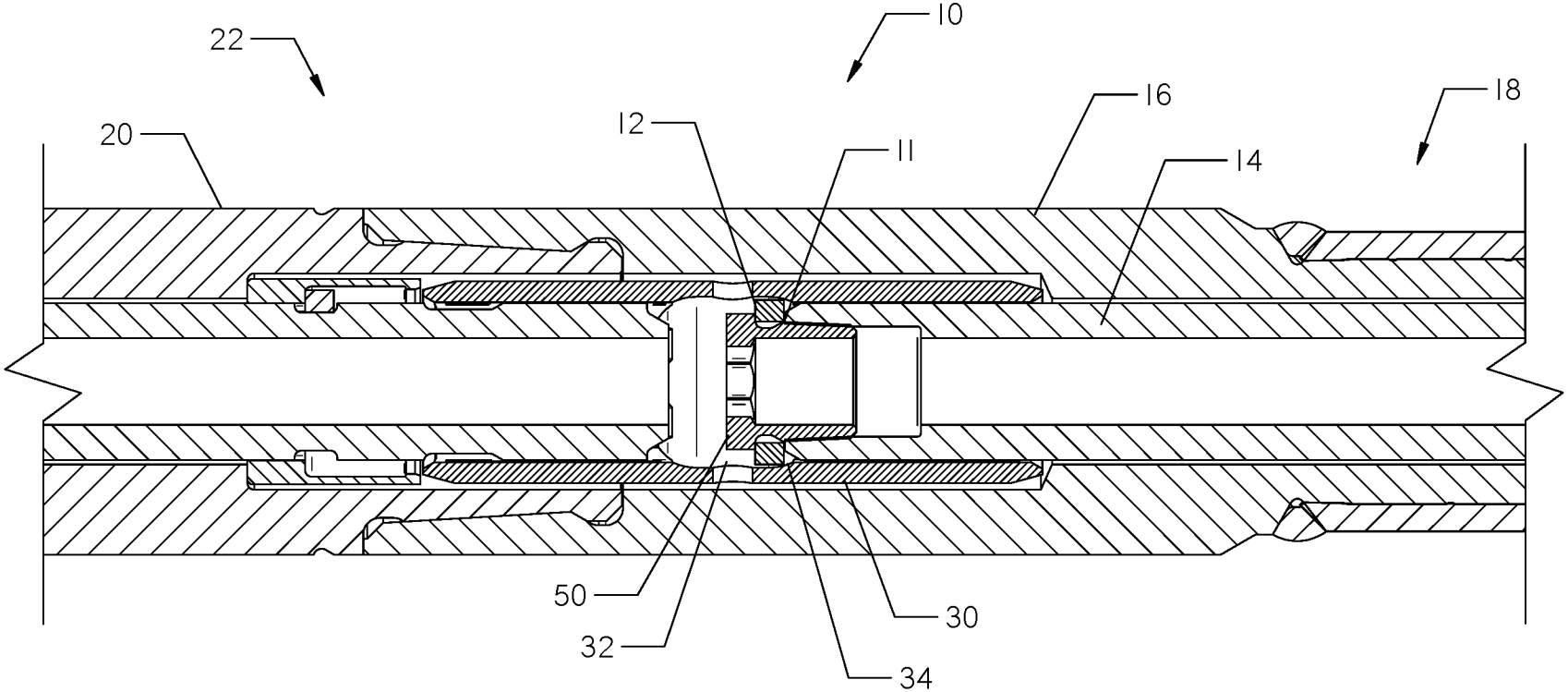
FIG. 1 is a cross-sectional view of an assembly comprising a bolt and a planar ring configured to retain a rod within a collar in accordance with the present invention. The ring and bolt are installed within the collar at a spherical groove, with an internal rod threaded to the bolt and thus retained in place.

Turning now to the Figures, and FIG. 1 in particular, a torque-transmitting assembly 10 is shown. This assembly 10 is installed at an end ii of an inner member 14. The inner member 14 is disposed within an outer member 16. The inner member 14 and outer member 16 together form a dual member pipe segment 18. An adjacent pipe segment 20 is connected thereto in FIG. 1, forming a pipe joint 22.

Figure 2:
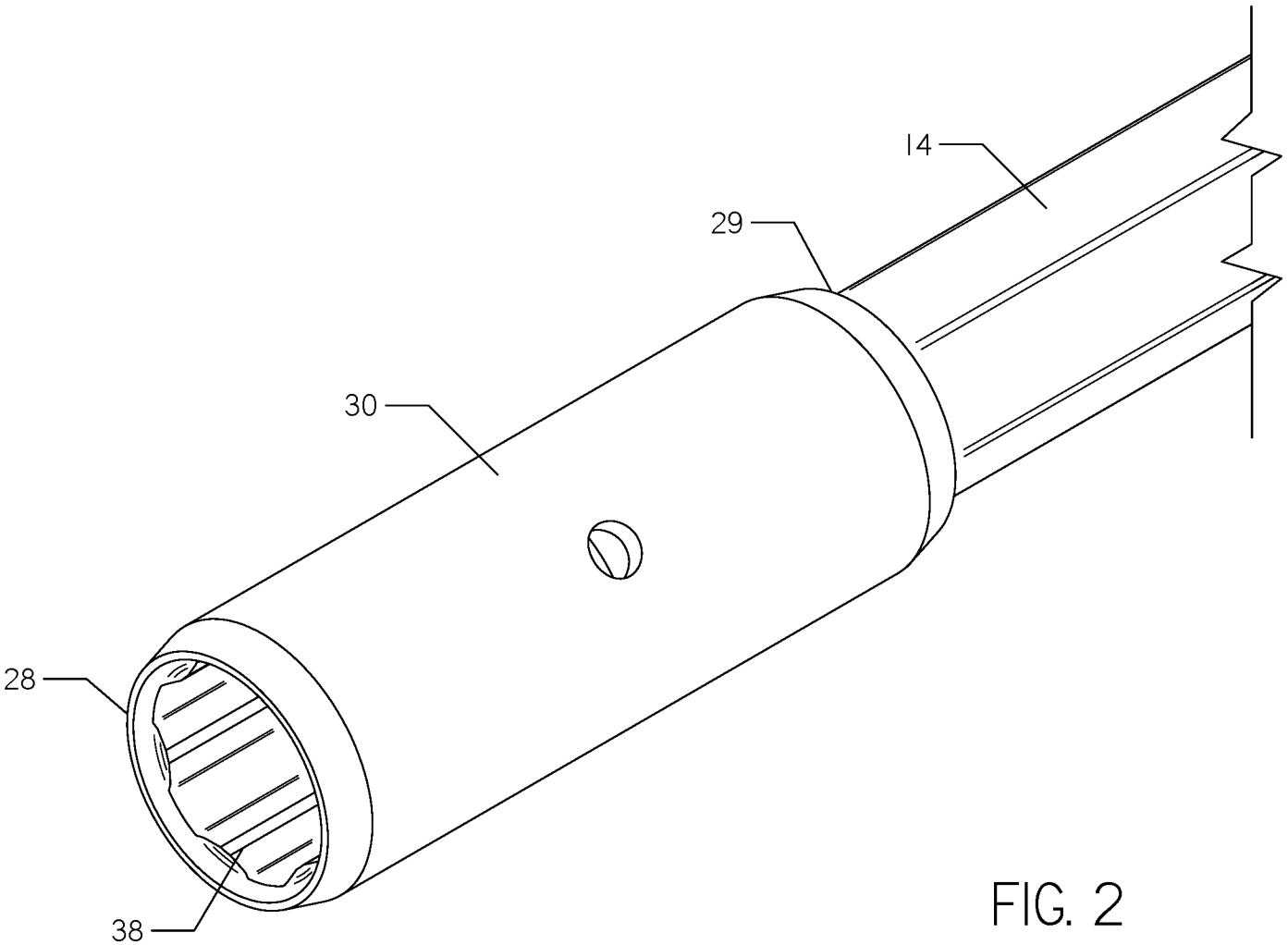
FIG. 2 is a perspective view of the collar, having been attached to a pipe member.

The assembly 10 comprises a ring 12, a bolt 50 and a collar 30. The assembly 10 is shown in its assembled form in FIG. 1. When made up, the inner member 14 and the collar 30 will be oriented as shown in FIG. 2, as a "box end" ready for attachment to an adjacent pin end of the adjacent pipe segment 20.

As shown, the "box end" formed by attachment of the assembly 10 to the inner member 14 is oriented in the downhole direction. The resulting orientation is referred to as a "pin up" orientation, with the drilling tool to the left and the drilling machine to the right of the pipe joint 22 shown in FIG. 1. It should be understood that a "pin down" orientation would also be possible, with the assembly 10 being installed on the inner member of the adjacent pipe segment 20, ready for attachment to the dual member pipe segment 18.

When joined together at a pipe joint 22, the pipe segment 18 and, in particular, the inner member 14, is rotated by a drilling machine (not shown) to impart rotational force to the open end of the collar 30 in which it is situated. The collar 30, in turn, transfers that torque to the inner member of the adjacent segment 20. A series of such pipe joints 22 may be used to transfer rotational torque to a downhole member (not shown) such as a drill bit or other tool. Thus, the assembly 10 of the current invention is used to keep the assorted inner members 14 from decoupling at the pipe joint 22.

The collar 30 comprises a through-passage 31 which extends from a first end 28 to a second end 29. The through-passage 31 is disposed substantially about the longitudinal axis 21 of the dual-member pipe segment 18. With reference to FIGS. 1 and 6-11, an internal groove 32 is provided inside the torque-transmitting collar 30, interrupting the through-passage 31 at a location intermediate the two ends 28, 29 of the collar.

Figure 4:
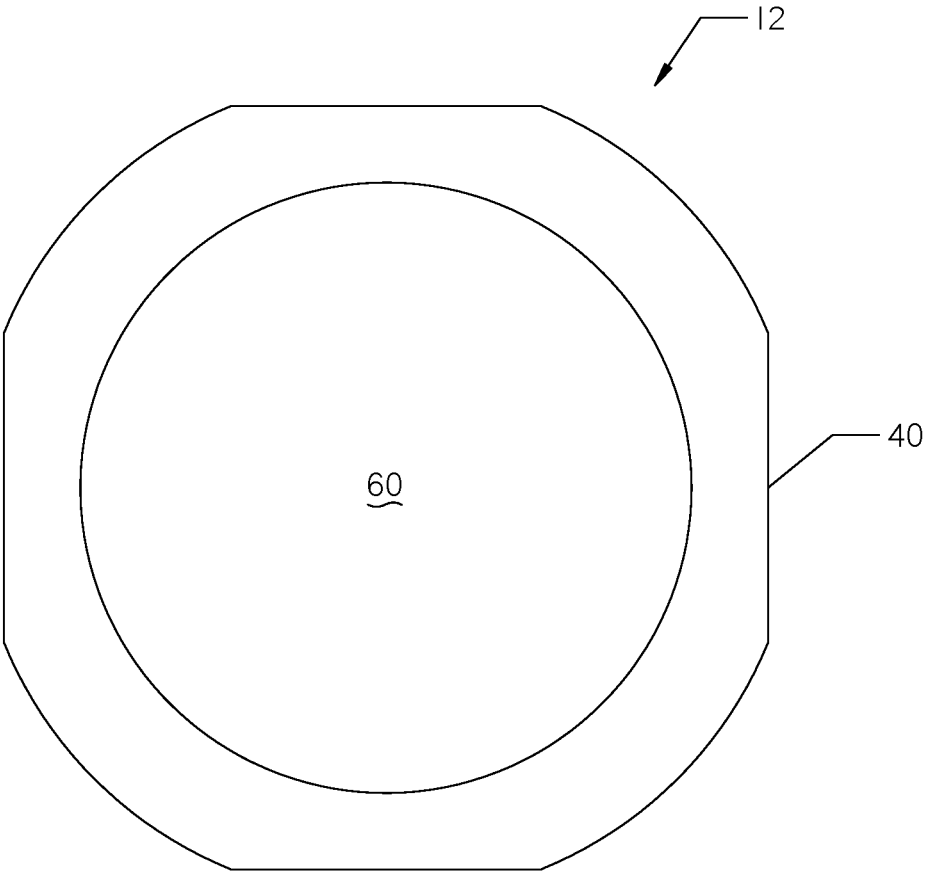
FIG. 4 is an end plan view of the ring.

The groove 32 is preferably spherical, though other grooves will work with the present invention. The limits of the groove 32 serve as a surface 34 that the ring 12 contacts at its end 33. As shown in FIG. 4, the ring has truncated sides 40 along its circumference. The ends 33 are flat, allowing the ring 12 to contact and act upon to transmit linear forces from the inner pipe member 14 to the collar 30 at the surface 34. Other shapes may be used at the ring's ends, so long as the ring is sized to enter the first end 28 of the collar 30 to reach groove 32 as discussed below.

Figure 3:
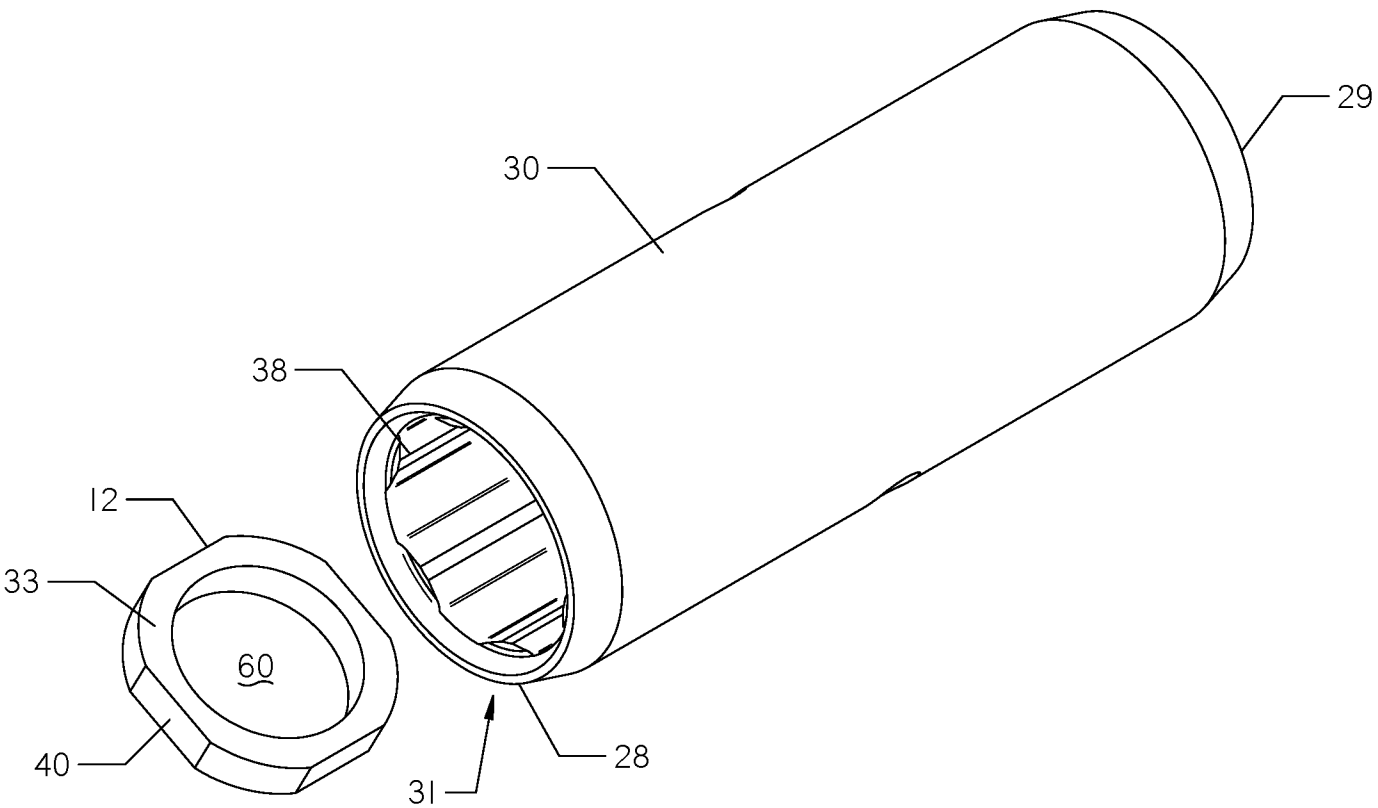
FIG. 3 is a perspective view of the collar with the ring shown in preparation for installation therein. The ring is shown having an annular shape with a truncated outer surface, allowing for placement between the internal splines of the collar.

An internal profile 36 (FIG. 12) of the inner diameter of the through-passage 31 of collar 30 allows for a plate or sheet of substantial thickness, such as the ring 12, to pass through the shape into the spherical groove 32 when oriented correctly. This orientation is shown in FIG. 3. The profile 36 includes splines 38 having a smaller effective inner diameter than the outer diameter of the ring 12. The ring 12 may be passed along the larger inner diameter portions between the splines 38.

Alternatively, the profile 36 of the through-passage 31 may be a polygon, such as a hexagon, interrupted with a groove 32. Such a profile 36 might require changes to the shape of the ring 12, to allow it to pass through the through-passage 31 to the groove 32. Further, the profile 36 of the through-passage 31 may be different at each end of the collar 30. For example, the splines 38 or geometric shape of the profile 36 may not be aligned on opposite sides of the groove 32.

Figure 7:
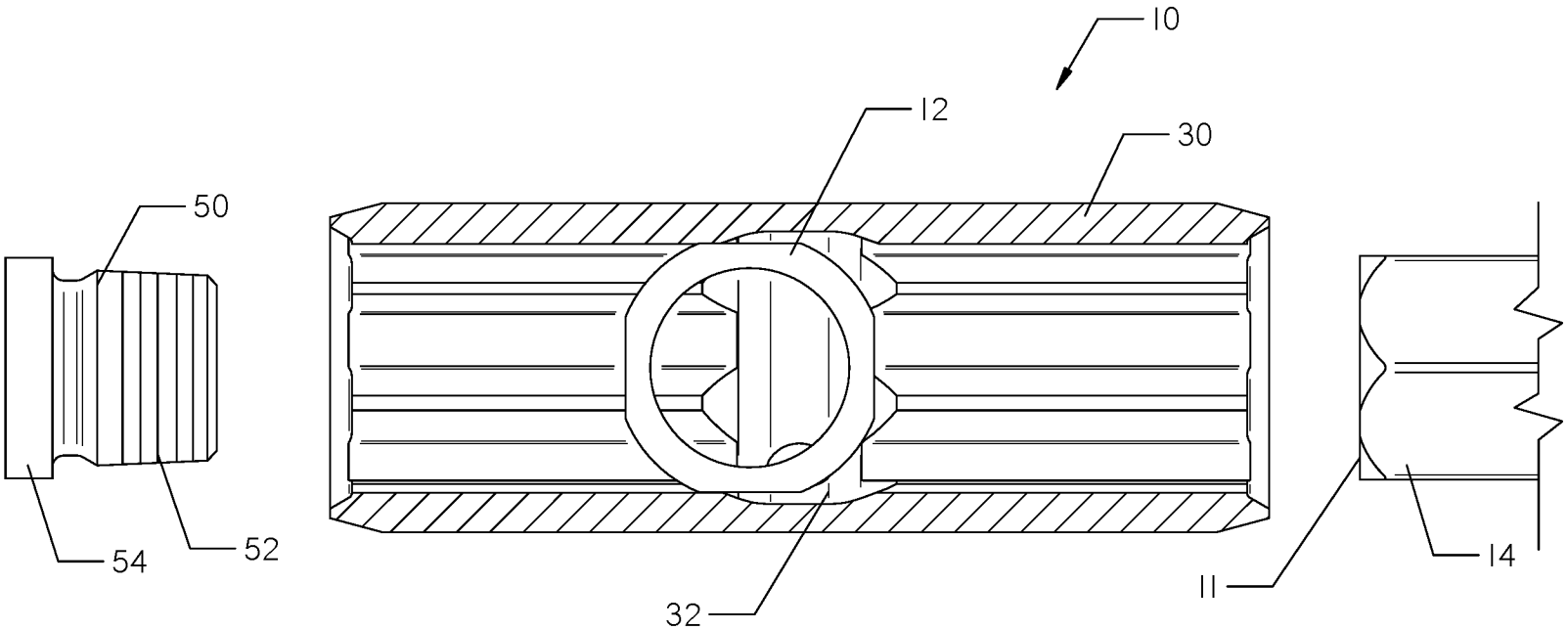
FIG. 7 is the view of FIG. 6, with the ring oriented within the collar such that its through-passage is substantially perpendicular to the longitudinal axis of the collar, allowing installation therein.
Figure 12:
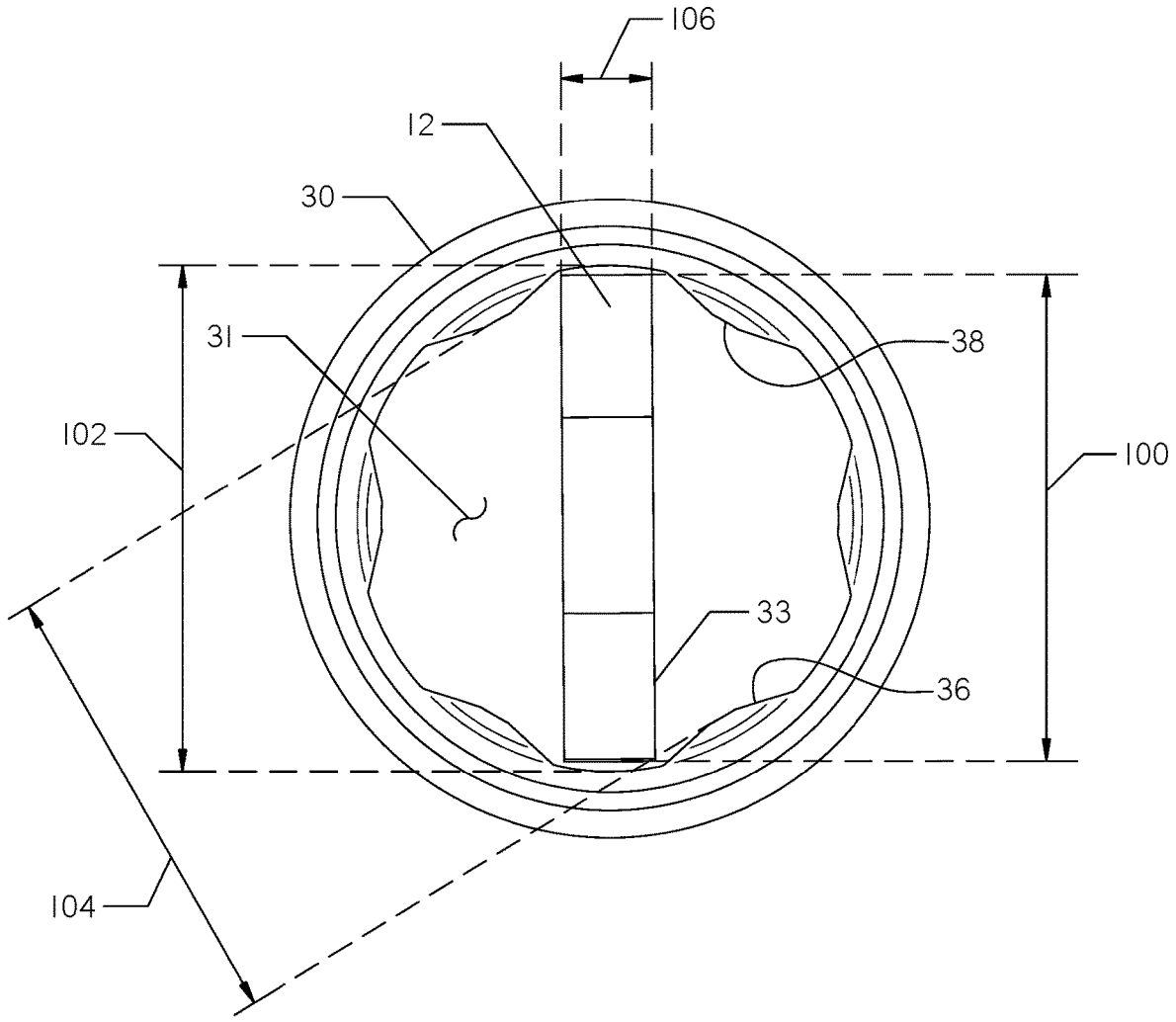
FIG. 12 is an end view of the collar in the same orientation as FIG. 7, with the ring positioned within it at an angle. In particular, the through-passage of the ring is substantially perpendicular to the longitudinal axis of the collar, and the width of the ring is passing between the splines which exist at each end of the collar. Only the ring and collar are shown, for clarity.

In FIG. 12, the ring 12 is oriented within the collar 30 as also shown in FIG. 7. While the internal profile 36 of the collar 30 can limit the thickness and general robustness of the ring 12, the ring 12 could reach far enough into the collar 30 so as to properly engage it and provide similar benefits of assembly. Benefits include being able to assemble and disassemble the dual pipe segment 18 when there is only access to the end of the pipe, such as when the pipe segment 18 is loaded in the pipe box (not shown).

As best shown in FIG. 12, the minimum width 100 of the ring 12 is less than a maximum cross-sectional clearance 102 of an end of the collar 30 along the thickness 106 of the ring 12. However, the splines 38 protrude into the internal passage of the collar 30. Once rotated within the collar 30 to the position shown in FIG. 9, the outer diameter of the ring 12 has an effective diameter which is greater than the effective diameter 104 of each end of the collar. This causes the collar 30 to be maintained within the groove 32.

Figure 5:
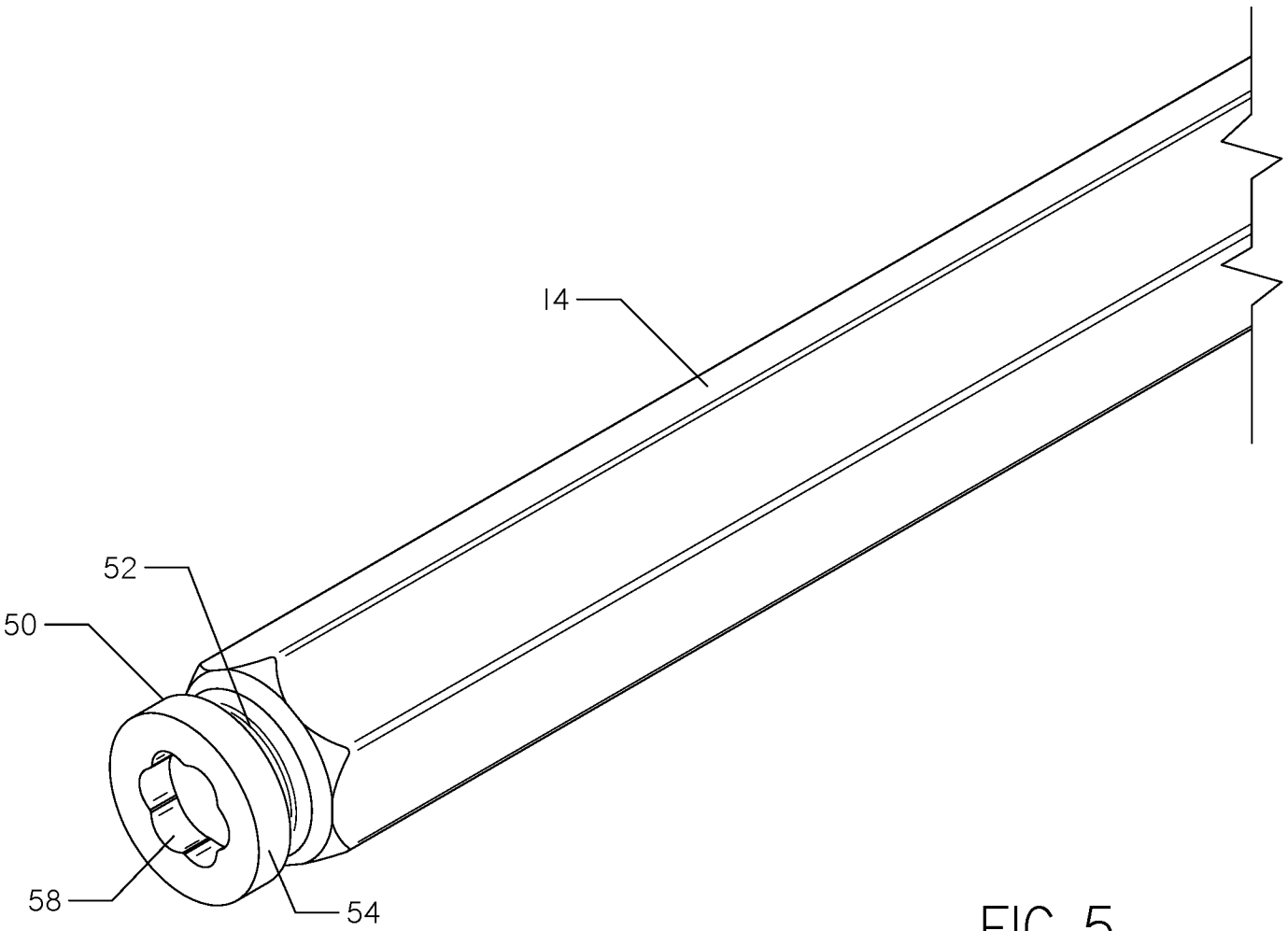
FIG. 5 shows a bolt adapted for installation into an end of an inner pipe member. The bolt has a torque-transmitting surface to allow for threading and unthreading from the inner pipe member.

Once the ring 12 is installed in the collar 30, the bolt 50 can be used to engage the ring 12. The bolt 50 may be hollow or solid and preferably defines threads 52. The bolt 50 may be threaded into a corresponding feature on the inner pipe member 14. The bolt 50 is shown being threaded to the inner pipe member 14 in FIG. 5. Preferably, the threads 52 would be a tapered thread or any thread capable of resisting loosening due to vibration, such as national pipe threads, interference threads, or threads with retention compounds applied. The bolt 50 further comprises a flange 54 disposed at an end of the bolt opposite the threads 52.

Figure 6:
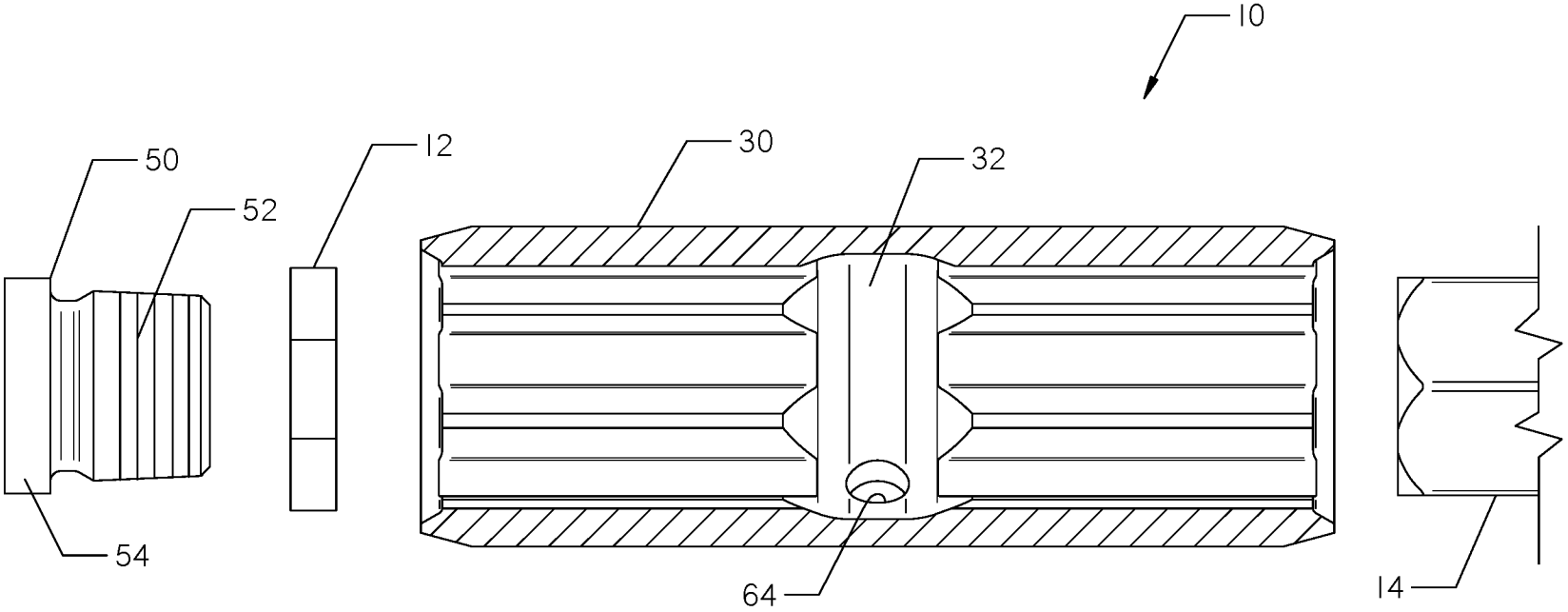
FIG. 6 is a partially sectional exploded end view of the components of the assembly. The collar is shown sectioned, such that the internal groove and splines are visible. The ring, bolt, and inner pipe member are shown in side plan view.
Figure 8:
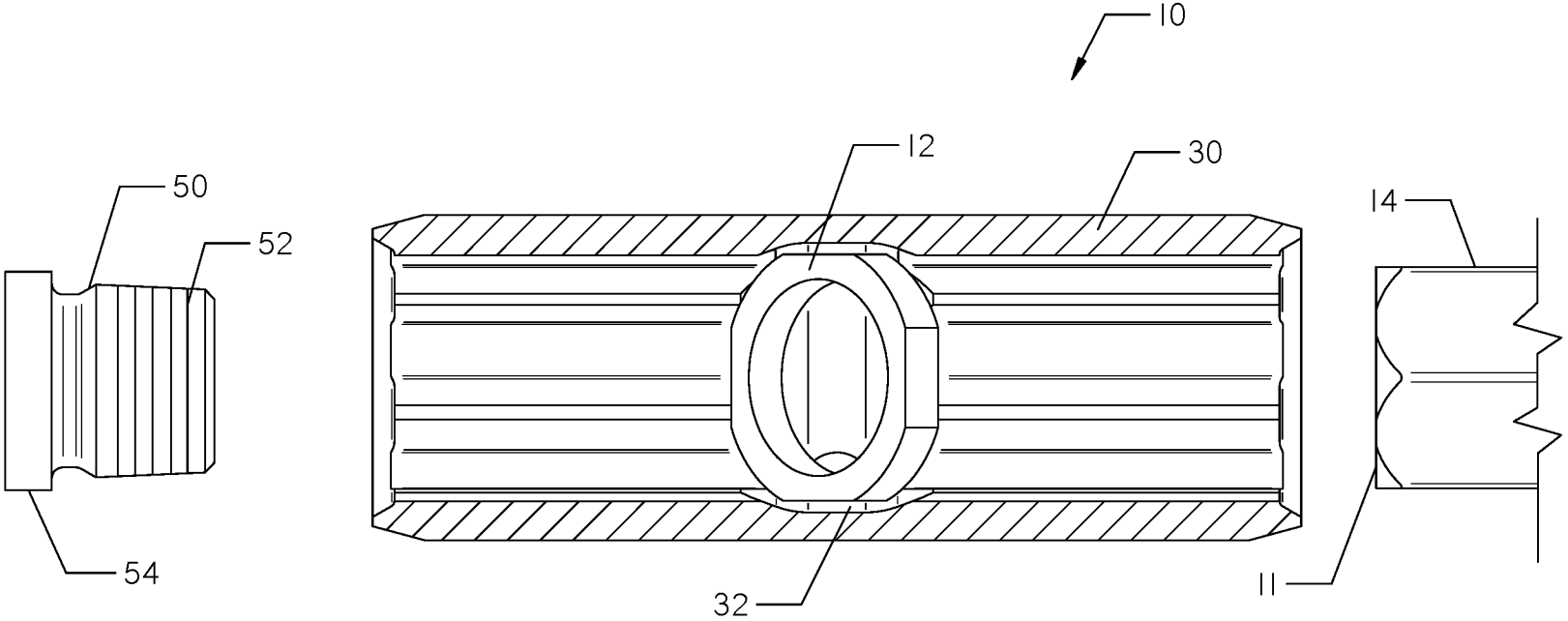
FIG. 8 is the view of FIG. 7, further modified by rotating the ring within the internal groove of the collar.
Figure 9:
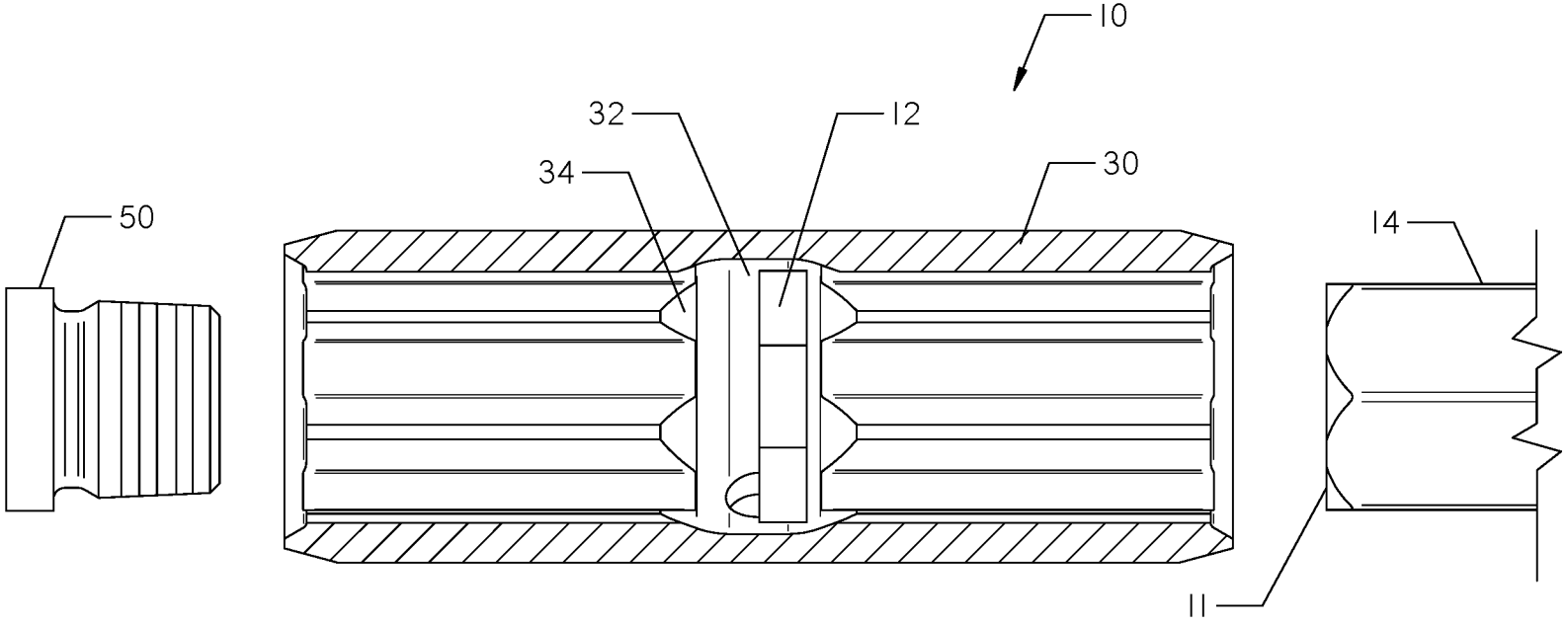
FIG. 9 is the view of FIG. 7, with the ring fully rotated such that its through-passage is in line with the longitudinal axis of the collar.
Figure 10:
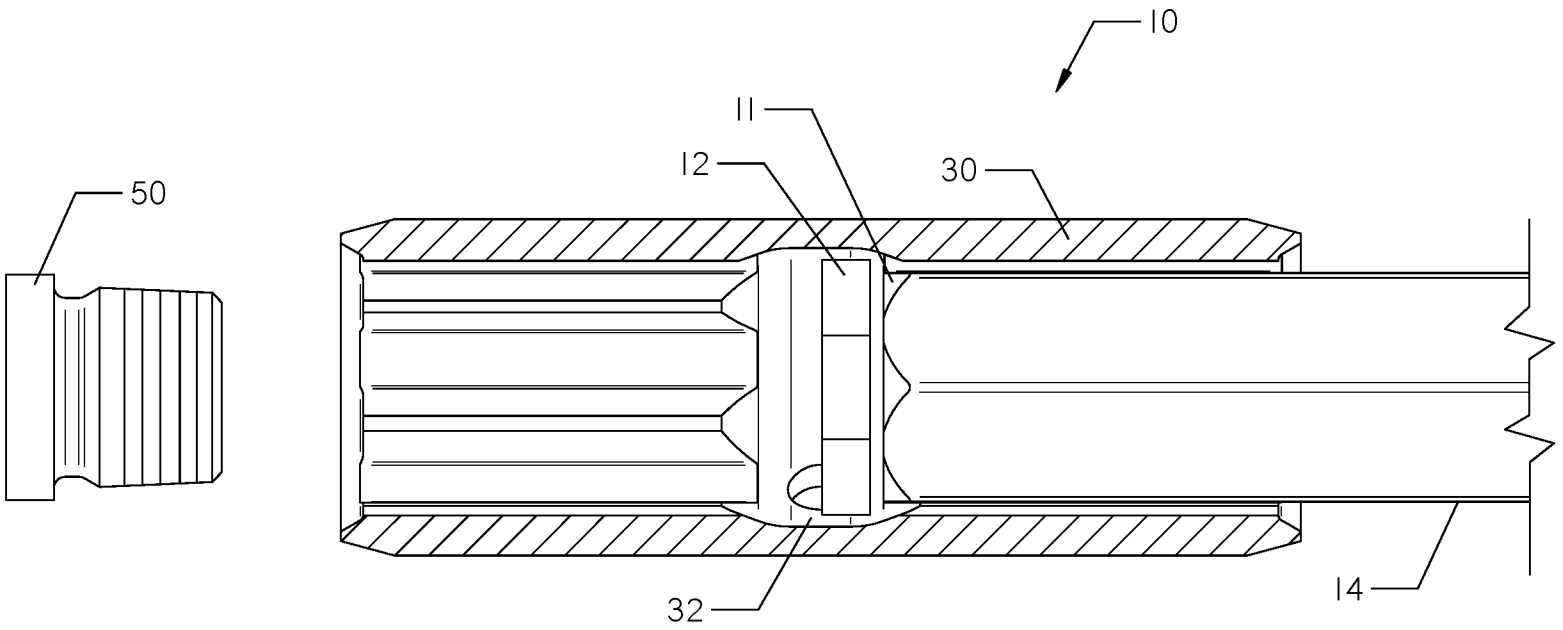
FIG. 10 is the view of FIGS. 6-9, with the inner pipe member placed within one end of the collar.
Figure 11:
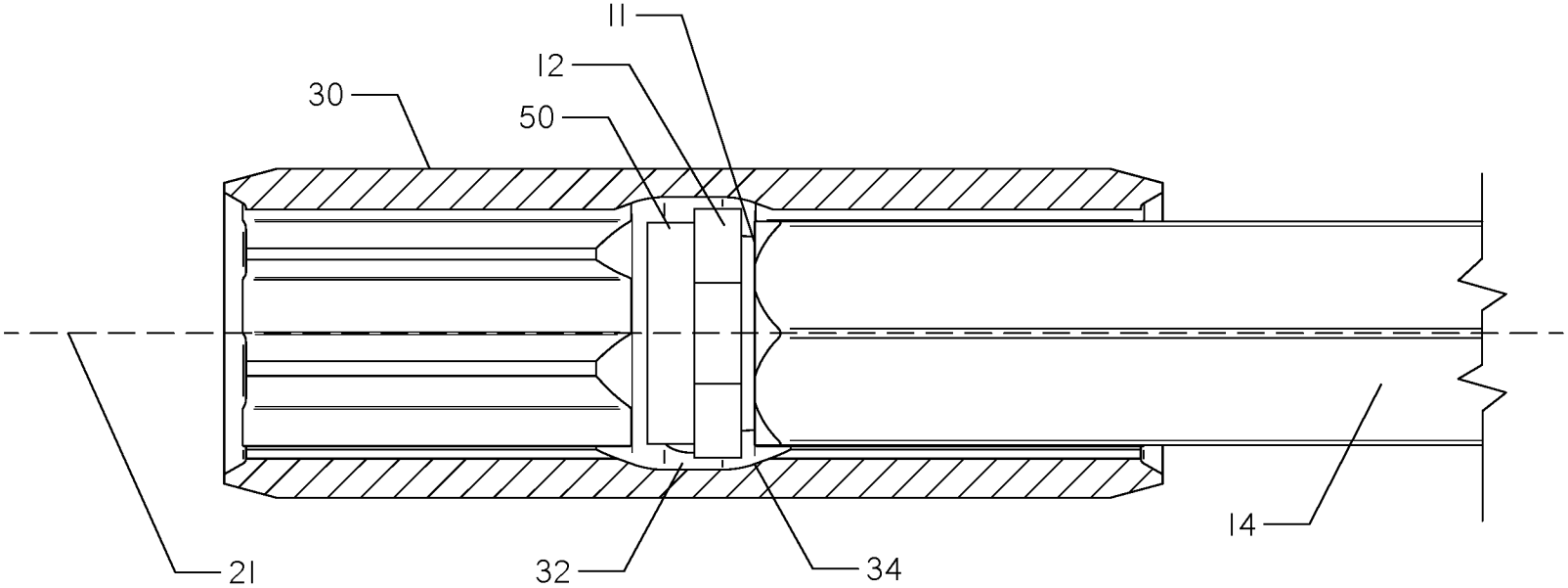
FIG. 11 is the view of FIGS. 6-10, with the bolt inserted through an end of the collar and installed in the assembly, such that the ring is disposed between the flange of the bolt and the end of the inner pipe member.

FIGS. 6-11 show the sequential installation of the ring 12 and bolt 50 to form the assembly 10 of the present invention in stepwise fashion. In FIG. 6, the inner pipe member 14, ring 12, collar 30, and bolt 50 are separately arranged. In FIG. 7, the ring 12 is placed into the collar 30 and moved towards the internal groove 32. In FIGS. 8 and 9, respectively, the ring 12 is turned such that its through-passage, or aperture 60 (FIG. 4) is aligned with the through-passage 31 of the collar 30. In FIG. 10, the inner pipe member 14 is inserted into the second end 29 of the collar 30. In FIG. 11, the bolt 50 is threaded to the inner pipe member 14, with the ring 12 disposed between the flange 54 of the bolt 50 and the inner pipe member 14.

When fully assembled as in FIG. 1 and Figure ii, the bolt 50 would allow the ring 12 to "float" and only transfer forces from either the bolt 50 to the ring 12 or from the inner pipe member 14 to the ring 12 along a longitudinal axis 21 of the drill string 20. Transfer along only one of the paths at a time would tend to decrease the amount of torque that can be conveyed through the bolt 50 to the ring 12 and to the collar 30. The inner diameter of the ring 12 is not in torque transferring relationship with the bolt 50. All rotational forces may be transferred from one drill pipe inner pipe member 14 to the collar 30 to the next inner pipe member 22, without transferring torque to the bolt 50 or ring 12.

A cross hole 64 (FIG. 6) can be placed in the collar 30 for access to the ring 12 or to provide a place to insert tools for disassembling a damaged collar 30. The bolt 50, if hollow, may have a torque-transmitting feature 58 that can be engaged during installation. Such a feature 58 could be a shape to allow torque-transmission and to provide a maximum flowable area. The feature 58 could also be a more traditional male or female hexagon, or similar to a flat blade screwdriver engagement where a key engages a slot.

Figure 13:
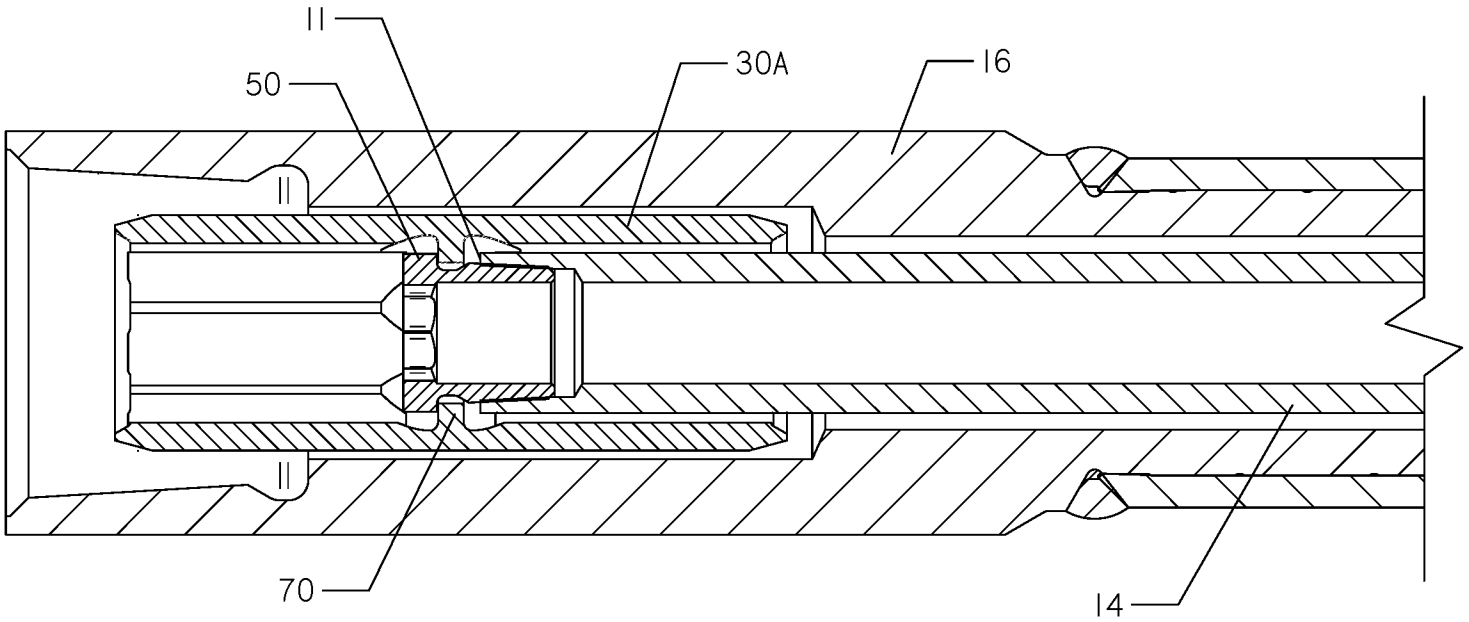
FIG. 13 is a sectional side view of an alternative design, wherein an integral flange is formed within the internal groove of the collar.

As shown in FIG. 13, an alternative collar 30A has an integrally formed protrusion 70 which can perform a similar function as the ring 12. The assembly 10 can work with a collar having a traditional hexagonal cross-sectional profile, or with a butterfly hex profile as shown in FIG. 12.

When the phrase "diameter" is used in the appended claims with respect to a shape other than a circle, the term means that the largest distance between any pair of vertices—in other words, the length of the longest diagonal of that shape. "Diameter" does not limit the shape in which it is contained to any particular geometry.

The various features and alternative details of construction of the apparatuses described herein for the practice of the present technology will readily occur to the skilled artisan in view of the foregoing discussion, and it is to be understood that even though numerous characteristics and advantages of various embodiments of the present technology have been set forth in the foregoing description, together with details of the structure and function of various embodiments of the technology, this detailed description is illustrative only, and changes may be made in detail, especially in matters of structure and arrangements of parts within the principles of the present technology to the full extent indicated by the broad general meaning of the terms in which the appended claims are expressed.

The invention claimed is:

1. An assembly for coupling pipe segments, comprising:
a collar including a through-passage extending longitudinally from a first end to a second end, each end having an interior surface configured to engage with a pipe segment and an intermediate section located between the first and second ends and having a larger internal diameter than the central channel;
a ring configured to fit within the intermediate section, wherein:
the ring is positionable to engage with the through-passage in a first position and disengage in a second position, the ring defining a central aperture; and
a connector configured to secure a pipe segment within the collar, wherein the connector at least partially extends through the central aperture of the ring to maintain its position within the intermediate section of the through-passage; and
wherein the collar, ring, and connector are collectively configured to enable torque transmission between coupled pipe segments.

2. The assembly of claim 1, wherein the connector comprises a bolt with a flange, and the flange has a greater diameter than the aperture of the ring.

3. The assembly of claim 1, wherein the intermediate section of the collar is a spherical groove.

4. The assembly of claim 1 further comprising a cross hole in the collar, wherein the ring is configured to be accessed through the cross hole.

5. The assembly of claim 1, wherein the ring is configured to rotate within the intermediate section to transition between the first and second positions.

6. A system, comprising:
a first pipe segment; and
the assembly of claim 1, wherein:
the first end of the collar is disposed about the first pipe segment, the ring is in the first position, and the connector is disposed through the ring to maintain its position.

7. The system of claim 6 wherein the connector is attached to the first pipe segment.

8. The system of claim 7 wherein the connector is attached to the first pipe segment by threads.

9. The system of claim 6 further comprising:
a second pipe segment, wherein the second pipe segment is disposed within the second end of the collar.

10. The system of claim 9 wherein the first pipe segment, collar and second pipe segment are in torque-transmitting relationship.

11. An assembly for coupling pipe segments, comprising:
a collar including a through-passage extending longitudinally from a first end to a second end, each end having an interior surface configured to engage with a pipe segment including a torque-transmitting feature, wherein the torque-transmitting feature comprises a polygonal profile; and
an intermediate section located between the first and second ends and having a larger internal diameter than the through-passage;
a ring configured to fit within the intermediate section, wherein:
the ring is positionable to engage with the through-passage in a first position and disengage in a second position; and
a connector configured to secure a pipe segment within the collar, wherein the connector interacts with the ring to maintain its position within the intermediate section; and
wherein the collar, ring, and connector are collectively configured to enable torque transmission between coupled pipe segments.

12. An assembly comprising:
a retainer, wherein:
in a first orientation, the retainer presents a first profile with a first maximum width; and
in a second orientation, the retainer presents a second profile with a second maximum width, wherein the first maximum width is less than the second maximum width;
a collar having a primary passage and an intermediate section, wherein the intermediate section interrupts the primary passage and wherein the primary passage has an inner diameter larger than the first maximum width but less than the second maximum width; and
a bolt, connectable to a first pipe section while the retainer is within the intermediate section of the collar in the second orientation, such that the bolt maintains the retainer in the second orientation.

13. The assembly of claim 12 wherein the first orientation is perpendicular to the second orientation.

14. The assembly of claim 12 wherein the intermediate section is a spherical groove.

15. The assembly of claim 12 wherein:
the first pipe section is disposed at least partially within the primary passage of the collar;
the bolt is attached to the first pipe section; and
the retainer is in the second orientation and maintained in the second orientation by the bolt.

16. A method of using the assembly of claim 12, comprising:
placing the collar over an end of a first pipe section;
placing the retainer into the collar while the retainer is in the first orientation; and
when the retainer is within the intermediate section of the collar, moving the retainer from the first orientation to the second orientation.

17. The method of claim 16 further comprising:

connecting the bolt to the first pipe section while the retainer is within the intermediate section of the collar in the second orientation, thereby maintaining the retainer in the second orientation.

18. The method of claim 17 further comprising:

thereafter, placing the collar over an end of a second pipe section.

* * * * *